US008267150B2

(12) United States Patent
Eichenberger et al.

(10) Patent No.: US 8,267,150 B2
(45) Date of Patent: Sep. 18, 2012

(54) APPARATUS FOR STARTING THE CASTING OF A CONTINUOUS CASTING SYSTEM

(75) Inventors: Philip Eichenberger, Küsnacht (CH); Thomas Meier, Schaffhausen (CH)

(73) Assignee: SMS Concast AG, Zurich (CH)

( * ) Notice: Subject to any disclaimer, the term of this patent is extended or adjusted under 35 U.S.C. 154(b) by 0 days.

(21) Appl. No.: 12/963,696

(22) Filed: Dec. 9, 2010

(65) Prior Publication Data

US 2011/0146936 A1 Jun. 23, 2011

(30) Foreign Application Priority Data

Dec. 18, 2009 (EP) ..... 09015739

(51) Int. Cl.
*B22D 11/08* (2006.01)
*B22D 11/16* (2006.01)

(52) U.S. Cl. ..... 164/153; 164/426; 164/446

(58) Field of Classification Search ..... 164/425–426, 164/445–446, 483, 152–153
See application file for complete search history.

(56) References Cited

U.S. PATENT DOCUMENTS 3,707,181 A * 12/1972 Schulz ..... 164/152
3,823,763 A * 7/1974 Hofmann et al. ..... 164/426
4,286,649 A * 9/1981 Rokop et al. ..... 164/446
4,685,506 A * 8/1987 Fasano ..... 164/416
5,131,453 A * 7/1992 Ros Navarro et al. ..... 164/445

FOREIGN PATENT DOCUMENTS

| | | | |
|---|---|---|---|
| DE | 20 23 282 | A1 | 11/1971 |
| DE | 23 40 844 | A1 | 2/1975 |
| DE | 26 29 453 | A1 | 1/1978 |
| DE | 34 46 404 | A1 | 8/1985 |
| DE | 41 32 185 | A1 | 4/1993 |
| EP | 2 335 847 | A1 | 12/2009 |
| FR | 25 72 315 | A1 | 5/1986 |

OTHER PUBLICATIONS

Abstract of DE 20 23 282 A1, Nov. 25, 1971.
Abstract of DE 34 46 404 A1, Aug. 1, 1985.
Asbtract of FR 25 72 315 A1, May 2, 1986.
Abstract of DE 41 32 185 A1, Apr. 1, 1993.

* cited by examiner

*Primary Examiner* — Kuang Lin
(74) *Attorney, Agent, or Firm* — Brian Roffe

(57) ABSTRACT

An apparatus for starting the casting of a continuous casting system has a mold (2) and a strand guide (10; 10') comprising drive and guide rollers (11, 12; 11', 12'). Moreover, a dummy bar (22) that can be introduced into the mold (2) by the strand guide (10; 10') and be withdrawn from said mold is provided. A safety device (20; 20') for the dummy bar (22) has an element (25) that can be engaged, with form fit, with the dummy bar (22) and limiting the speed of the cold bar (22). It is thus guaranteed that a predetermined maximum strand speed can not be exceeded and that the dummy bar does not slide through.

20 Claims, 3 Drawing Sheets

APPARATUS FOR STARTING THE CASTING OF A CONTINUOUS CASTING SYSTEM

FIELD OF THE INVENTION

The invention relates to an apparatus for starting the casting of a continuous casting system which has a mould and a strand guide comprising drive and guide rollers, with a dummy bar that can be introduced into the mould via the strand guide and be withdrawn from the mould.

BACKGROUND OF THE INVENTION

It is known for starting the casting of a continuous casting system to tightly close off the lower mould opening before and during the casting start-up process with a dummy bar in order to prevent steel poured into the mould from flowing out. The dummy bar is introduced into the mould via the strand guide provided for the casting strand and which comprises the drive and guide rollers. The steel poured into the mould is partially solidified so that a strand with a solidified edge zone and a liquid core is produced. As soon as this edge zone is of a sufficient thickness, the dummy bar (and after the latter the hot strand, additional steel then being poured into the mould) is drawn out of the mould, once again by means of the strand guide.

The movement of the dummy bar is determined by the drive torque generated by the drive rollers and by the contact force and friction coefficients between the drive and guide rollers and the dummy bar. Interruptions, such as for example with a power failure, can lead to an uncontrollable movement of the dummy bar. This can lead to damage to the system, both when running in and when starting the casting.

OBJECTS AND SUMMARY OF THE INVENTION

The object forming the basis of the present invention is to provide an apparatus of the type specified at the start wherein the risk of the dummy bar sliding through is largely eliminated.

This object is achieved according to the invention by an arrangement including a dummy bar adapted to be introduced into and withdrawn from the mould and a safety device for the dummy bar which includes a toothed wheel operatively connected to the dummy bar in the manner of a rack and pinion or toothed wheel drive and which is configured to apply a braking force when a predetermined speed generated by the drive rollers for the dummy bar is exceeded.

Further preferred embodiments of the apparatus according to the invention form the subject matter of the dependent claims.

Since according to the invention a safety device is provided for the dummy bar which has an element which can be engaged, with form fit, with the dummy bar and limiting the speed of the dummy bar, it is guaranteed that a predetermined maximum strand speed can not be exceeded and the dummy bar will not slide through. The "form fit" engagement of the element of the safety device with the dummy bar means that the element of the safety device fits the form of, e.g., has a corresponding form as or shape to, a part of the dummy bar so that the element of the safety device can engage with the dummy bar. An example of a form fit is when the element of the safety device has the form of a toothed wheel that engages with teeth of the dummy bar in the manner of a rack and pinion or toothed wheel drive.

The element that can be engaged with the dummy bar is preferably in the form of a toothed wheel that is operatively connected to the dummy bar in the manner of a rack and pinion or toothed wheel drive. Upon exceeding the predetermined speed generated by the drive rollers for the dummy bar the toothed wheel element applies a braking force or a rotary resistance to the dummy bar.

Here the safety device advantageously comprises an autonomous, hydraulic circuit system with a pump, for example a toothed wheel pump (which is operatively connected to the toothed wheel element) and to a throttle. The practically resistance-free rotary resistance of the toothed wheel element during normal operation can be increased over the circuit system and over a transmission gearing when the dummy bar exceeds the speed due to sliding.

The safety device advantageously constitutes an autonomous system, for example independent of the roller drive, with which it is ensured that e.g. during a power failure and the loss of drive torque or contact force caused by the latter, no sliding through of the dummy bar takes place.

BRIEF DESCRIPTION OF THE DRAWINGS

In the following the invention is described in greater detail by means of the drawings. These show as follows.

DETAILED DESCRIPTION OF THE INVENTION

Figure 1:
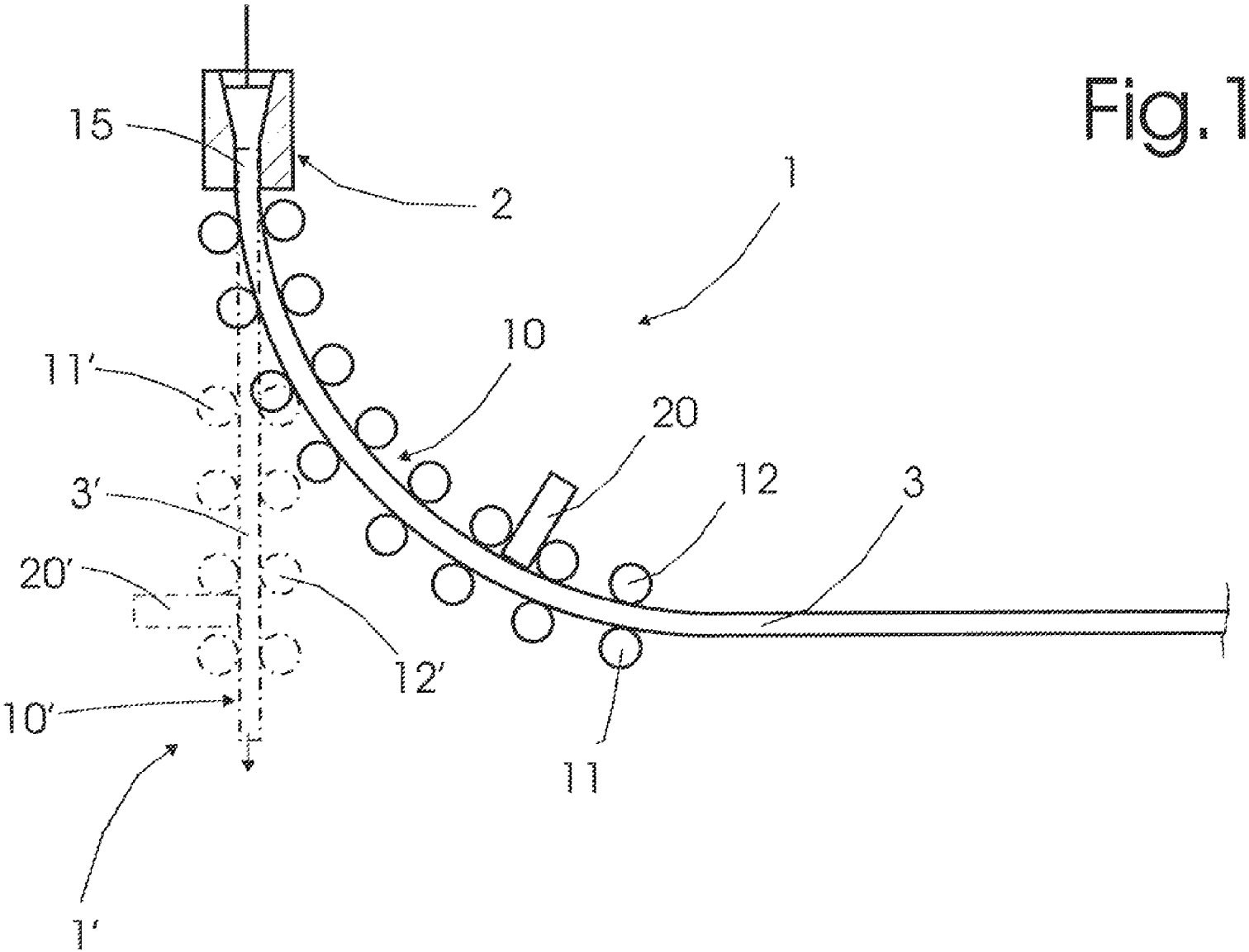
FIG. 1 shows a continuous casting system in diagrammatic form.

FIG. 1 shows diagrammatically the structure of a continuous casting system 1 comprising a mould 2 cooled with water which is filled with liquid metal, in particular steel. A casting strand 3 is taken out of the mould 2 such as to form a shell which is a pre-profile. The casting strand 3 is conveyed away by means of rollers 11, 12 of a curved guide 10 and bent into the horizontal. As indicated by dashes in FIG. 1, the casting strand 3' could also be led away vertically by means of a vertical strand guide 10'.

Whereas the rollers 11 disposed on the outside of the curved strand guide 10 and of the strand produced in the curved strand guide 10 are fixed guide rollers, the rollers 12 located on the inside of the curved strand guide 10 form the drive rollers and can be adjusted radially to the casting curve.

To one side the vertical strand guide 10' also has guide rollers 11' positioned securely, and to the other side perpendicular to the vertical casting direction adjustable drive rollers 12'.

As is known, a dummy bar is also moved and held over the strand guides 10, 10', and this is used for starting the casting of the corresponding continuous casting system 1, 1' and is used to tightly close off the lower mould opening 15 before and during the casting start-up process in order to prevent steel poured into the mould 2 from flowing out. After the steel poured into the mould 2 has partially solidified so that a strand with a sufficiently thick solidified edge zone and liquid core has been produced—the dummy bar introduced into the mould 2 by means of the strand guide 10 and 10' is also drawn out again by means of the strand guide 10 and 10' Here the movement of the dummy bar while introducing and while drawing out is determined by the drive torque generated by the drive rollers 12, 12' and by the contact force and friction coefficients between the drive and guide rollers 11, 11'; 12, 12' and the dummy bar.

Both for the continuous casting system 1 with the curved strand guide 10 and for the vertical strand guide 10' a rigid dummy bar or a chain dummy bar can be used in a conventional manner.

According to the invention, both for the chain dummy bar conveyed through the curved strand guide 10 and for the rigid dummy bar conveyed through the vertical strand guide 10' a safety device 20 and 20' is provided which ensures that with a decline or loss of the contact force or the friction coefficient and with a decline or loss of the drive torque the dummy bar does not slide through, as this would inevitably lead to the continuous casting system 1 or 1' being damaged.

The safety devices 20, 20' indicated in FIG. 1 are designed on the same principle. With the continuous casting system 1 provided with the curved strand guide 10 the safety device 20 is disposed on the inside of the strand guide 10, in the same way as the drive rollers 12. With the continuous casting system 1' provided with the vertical strand guide 10' the safety device 20' is preferably disposed on the same side as the postionable rollers 12'.

Figure 2:
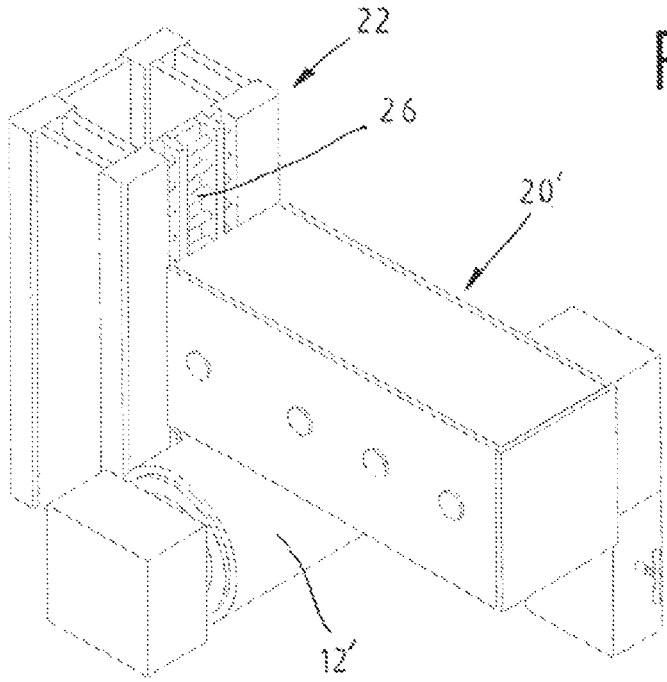
FIG. 2 is a perspective illustration of an exemplary embodiment of an apparatus according to the invention for starting the casting of a continuous casting system.
Figure 3:
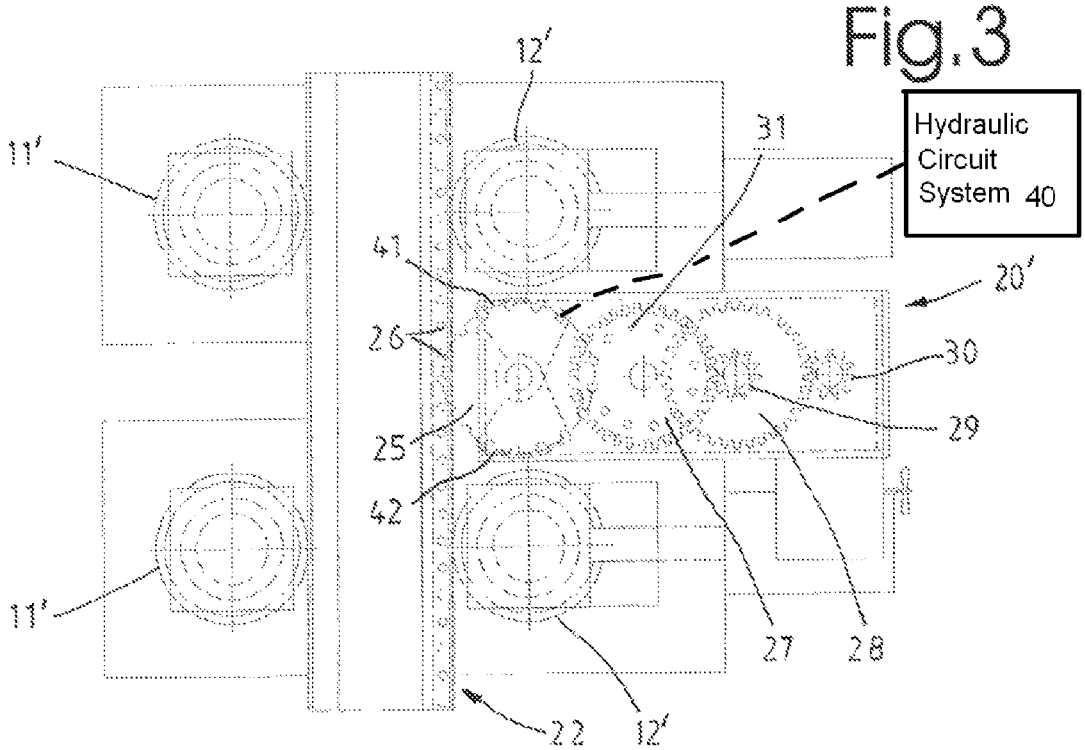
FIG. 3 shows the apparatus according to FIG. 2 as a vertical cross-section.
Figure 4:
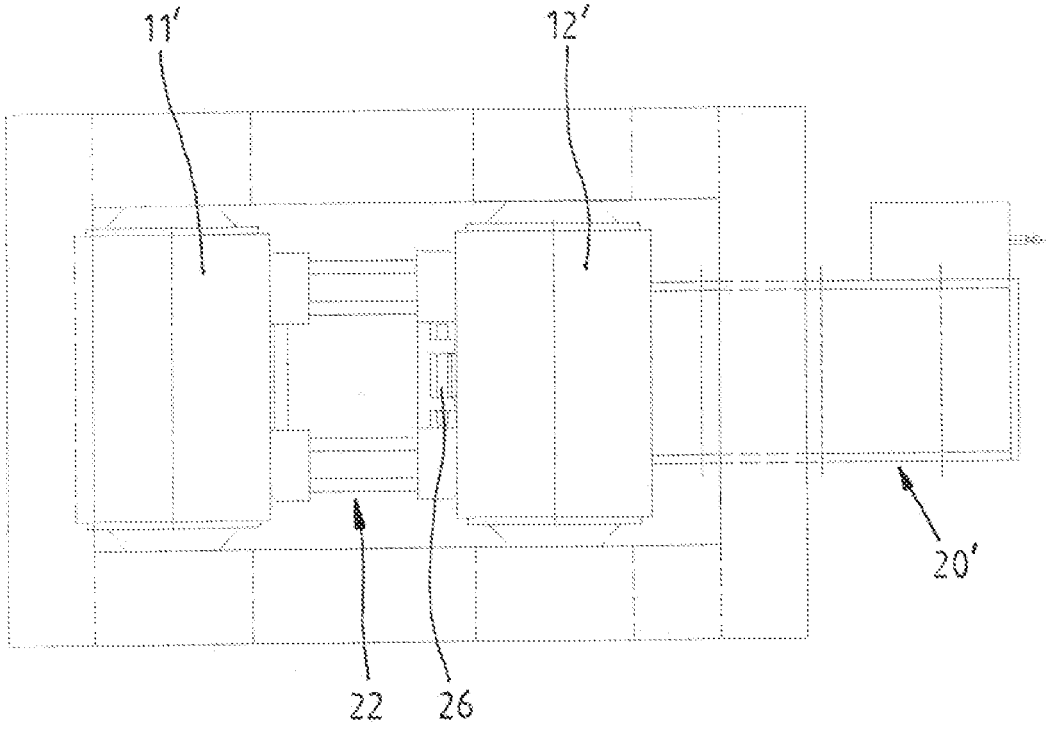
FIG. 4 is the top view of an apparatus according to FIG. 2.

In FIGS. 2 to 4 the safety device 20' provided for the vertical continuous casting system 1' and co-operating with the rigid dummy bar 22 is shown, and is described in greater detail in the following:

The safety device 20' according to the invention disposed on the same side as the drive rollers 12' has an element 25 in the form of a toothed wheel which can be engaged, with form fit, with teeth 26 of the dummy bar 22 in the manner of a rack and pinion or toothed wheel drive. With the exemplary embodiment shown the teeth 26 are formed by a plurality of transverse pins. (When using the chain dummy bar moved within the curved strand guide 10 the element can be engaged, with form fit, with the individual links of the chain dummy bar). The toothed wheel element 25 is coupled into the teeth perpendicularly to the direction of casting (with the curved strand guide 10 radial to the casting curve) and when drawn out must be uncoupled again in good time from the upper end of the dummy bar 22 or from the dummy bar head so that the subsequent hot strand is not damaged. This takes place automatically, for example with the aid of controllable a knee lever system, not shown in the drawings.

The safety device 20' further comprises an autonomous, hydraulic circuit system 40 having a hydraulic pump (which is operatively connected to the toothed wheel element 25) and a throttle (the circuit system is shown schematically in FIG. 3 and its operative connection to the toothed wheel element 25 is depicted by the dotted line). If a speed generated by the drive rollers 12' for the dummy bar 22 is exceeded due to sliding, the rotary resistance of the toothed wheel element 25 is increased by means of the hydraulic circuit system and by means of transmission gearing comprising further toothed wheels 27, 28, 29, 30 or rack and pinion teeth 31, and so applies a braking effect to the dummy bar 22 in quadratic speed/rotary resistance dependency.

Since the safety apparatus constitutes an autonomous system, for example independent of the roller drive, it is ensured that the dummy bar 22 does not slide through for example with a power failure and loss of the drive torque or the contact force caused by the latter.

As already mentioned, the toothed wheel element 25 (and also the transmission gearing 27, 28, 29, 30, 31) can be positioned for the purpose of coupling and uncoupling perpendicularly to the casting direction (or radially to the casting arch). Independently of this, the whole safety device 20' and 20 can be positioned in this direction—depending on the format of the casting strand 3 to be produced and of the corresponding blank bar, preferably together with the drive rollers 12' and 12 positionable in relation to the securely positioned guide rollers 11' and 11.

Furthermore, in FIG. 3 two pivotable protective caps 41, 42 are indicated which are illustrated in the open position in the engaged state of the toothed wheel element 25. If this toothed wheel element 25 is drawn back with the safety device 20', these protective caps 41, 42 are pivoted against the strand by a mechanism (not shown), and they then serve as a closed heat shield for the gear mechanism in this safety apparatus.

The invention claimed is:

1. An arrangement for starting casting of a continuous casting system that has a mould and a strand guide comprising drive and guide rollers, the arrangement comprising:

a dummy bar adapted to be introduced into and withdrawn from the mould via the strand guide, and a safety device for said dummy bar, said safety device comprising:

a hydraulic circuit system having a toothed wheel pump which is connected to a toothed wheel, and a throttle, said toothed wheel operatively connected to said dummy bar in the manner of a rack and pinion or toothed wheel drive, said safety device being configured to apply a braking force to said dummy bar when a predetermined speed generated by the drive rollers for said dummy bar is exceeded.

2. The arrangement of claim 1, wherein said toothed wheel is configured to be alternatingly connected to said dummy bar or disengaged or uncoupled from said dummy bar.

3. The arrangement of claim 2, wherein said toothed wheel is configured to be disengaged from said dummy bar upon drawing away said dummy bar from the strand guide.

4. The arrangement of claim 2, wherein said toothed wheel is configured to be automatically disengaged from said dummy bar upon drawing away said dummy bar from the strand guide.

5. The arrangement of claim 2, wherein said toothed wheel is configured to be automatically uncoupled from an upper end of said dummy bar upon drawing away said dummy bar from the strand guide.

6. The arrangement of claim 1, wherein said toothed wheel has a variable rotary resistance which causes application of the braking force when the predetermined speed generated by the drive rollers for said dummy bar is exceeded.

7. The arrangement of claim 1, said toothed wheel is configured such that the braking force applied by said toothed wheel to said dummy bar when the predetermined speed generated by the drive rollers for said dummy bar is exceeded is resistance to rotation of said toothed wheel whereby the rotary resistance of said toothed wheel reduces sliding movement of said dummy bar through the strand guide.

8. The arrangement of claim 1, wherein the strand guide is a curved strand guide, the guide rollers radially outward of the curved strand guide being securely positioned and the guide rollers radially inward of the curved strand guide being radially adjustable relative to a curvature of the curved strand guide, said safety device being arranged on a radially inward side of the curved strand guide such that said toothed wheel engages with said dummy bar in a radial direction of the curved strand guide.

9. The arrangement of claim 8, wherein said safety device and the guide rollers radially inward of the curved strand guide are adjustable relative to the guide rollers radially outward of the curved strand guide.

10. The arrangement of claim 1, wherein said dummy bar includes teeth, said toothed wheel engaging with said teeth of said dummy bar.

11. The arrangement of claim 10, wherein said teeth of said dummy bar are formed by a plurality of pins arranged in a direction transverse to a direction of movement of said dummy bar.

12. The arrangement of claim 1, wherein the strand guide is a vertical strand guide.

13. The arrangement of claim 11, wherein the guide rollers on a first side of the vertical strand guide are securely positioned and the guide rollers on a second, opposite side of the vertical direction of movement of said dummy bar are adjustable in a perpendicular direction relative to the strand guide, said safety device being arranged on the second side of the vertical strand guide.

14. The arrangement of claim 13, wherein said safety device and the guide rollers on the second side of the vertical strand guide are adjustable relative to the guide rollers on the first side of the vertical strand guide.

15. The arrangement of claim 1, wherein said safety device is adjustable together with at least some of the drive rollers relative to the strand guide.

16. The arrangement of claim 1, wherein when said toothed wheel is connected to said dummy bar, said toothed wheel is controlled to limit the speed of said dummy bar through the strand guide.

17. The arrangement of claim 1, wherein said safety device further comprises a transmission gearing for engaging said toothed wheel with said dummy bar and removing said toothed wheel from engagement with said dummy bar.

18. The arrangement of claim 1, further comprising at least one protective cap that forms a closed heat shield for shielding said toothed wheel when said toothed wheel is disengaged from said dummy bar.

19. The arrangement of claim 18, wherein said at least one protective cap is pivotable.

20. The arrangement of claim 18, wherein said at least one protective cap comprises two protective caps.

* * * * *

UNITED STATES PATENT AND TRADEMARK OFFICE

CERTIFICATE OF CORRECTION

PATENT NO. : 8,267,150 B2
APPLICATION NO. : 12/963696
DATED : September 18, 2012
INVENTOR(S) : Philip Eichenberger et al.

It is certified that error appears in the above-identified patent and that said Letters Patent is hereby corrected as shown below:

Col. 5, line 13, change "direction of movement of said dummy bar" to --strand guide-; and
Col. 5, line 14, change "strand guide" to --direction of movement of said dummy bar--.

Signed and Sealed this
Sixth Day of November, 2012

David J. Kappos

David J. Kappos
*Director of the United States Patent and Trademark Office*